United States Patent [19]

Golbe

[11] 4,001,805

[45] Jan. 4, 1977

[54] SOUND ACTIVATED ALARM SYSTEM

[76] Inventor: Alvin V. Golbe, 311 Lantana Ave., Englewood, N.J. 07631

[22] Filed: Apr. 3, 1975

[21] Appl. No.: 564,759

[52] U.S. Cl. ..... 340/280; 340/276; 340/261; 340/416

[51] Int. Cl.[2] ..... G08B 21/00

[58] Field of Search ..... 340/416, 276, 274, 261, 340/227 R, 148, 280; 116/67 R, 75

[56] References Cited

UNITED STATES PATENTS

| | | | |
|---|---|---|---|
| 2,905,762 | 9/1959 | Rettie et al. | 340/416 X |
| 3,761,912 | 9/1973 | Stettner et al. | 340/309.1 X |

*Primary Examiner*—John W. Caldwell
*Assistant Examiner*—William M. Wannisky
*Attorney, Agent, or Firm*—Pennie & Edmonds

[57] ABSTRACT

The present invention is in an alarm system including a sound generator, a sound responsive switching circuit and an alarm. The sound generator includes an element capable of snapping rapidly from one position to another upon change in a monitored condition. The switching circuit includes a sound activated switch which is energized in response to a sound of predetermined frequency eminating from the sound generator. This creates an electrical signal that passes through the switching circuit to actuate the alarm. The alarm may be audible and/or visual and the sound activated switch after a predetermined time may deenergize the audible alarm. The sound generator is positioned at the location where the change in condition is to be sensed. All other parts of the system are adapted to be spaced remotely therefrom. The condition which is monitored may include the entry into a building, the removal of objects from their normal position or an increase in temperature within a premises, all of which result in actuation of the sound generation and subsequent energization of the switching circuit and alarm.

7 Claims, 7 Drawing Figures

SOUND ACTIVATED ALARM SYSTEM

BACKGROUND OF THE INVENTION

Systems adapted for the protection of property including devices which may be activated at one location to provide a signal either of an unauthorized entry to a premises of the unauthorized displacement of an article within the premises at another location are known in the prior art. Representative of such systems are those which are illustrated and described in U.S. Pat. Nos. 3,247,502 to Eberts, 3,487,404 to Midkiff, 3,544,987 to McMann, Jr. et al. and 3,750,131 to Fletcher et al.

Briefly, the Eberts patent signals the displacement of an article by a pair of reed switches which are closed to provide a signal if there is a break in a flux path between a permanent magnet and an armature carried by the reed. In both Midkiff and McMann, Jr. et al. a switch between relatively movable parts of an access opening to a premises is actuated to provide a signal at a remote location. In the latter, the switch is operated by a change in flux caused by movement of a magnet relative to a reed switch. In Fletcher, a signal is generated at a remote location in response to the transmission and pick-up of an inaudible transmission from a hand-held instrument.

These systems all suffer from certain disadvantages, namely the first three all require connector leads which communicate from a power source to the location of the device which shall signal the unauthorized entry or unauthorized displacement. Therefore, whether or not the device is hidden from view, the connector leads most likely will be visible to intruders thereby to provide the opportunity to disable the system. Fletcher et al. suffers from a further disadvantage, namely that the system is not one which operates unattended but rather requires the use of a hand-held device which is operated by an individual. Therefore, if the need arises to transmit a signal, the sender may not receive assistance in time to remedy the situation which precipitated resort to use of the system.

BRIEF SUMMARY OF THE INVENTION

The system of the present invention overcomes the various problems mentioned above and has capability both of monitoring a change in a condition at one location and of responding to the change to actuate an alarm at another location. Response of the system to the changed condition is by means of the generation of an audible predetermined frequency sound. The audible sound is produced by a sound generator which is responsive to a change in force exerted on the generator to rapidly and audibly produce a snapping sound. The snapping sound of the sound generator is received by a spaced apart receiver, suitably hidden from view. The receiver includes a sound activated switch and functions electrically to close a circuit to an audible and/or visual alarm.

The system operates unattended. Therefore, the presence of an intruder is signalled by the intruder himself upon entry to the premises, movement within the premises or the removal of articles from a supporting location. Unattended operation keeps the owner of the premises from a situation of possible peril; and the sudden exposure of the presence of the intruder by either the audible or visual alarm is intended to result in the intruder seeking escape from apprehension or in alerting the appropriate personnel, such as security guards or the owner of the premises.

Also, the system, by virtue of the capability of generating an audible sound, does not require the need to connect a form of switch at the monitoring location to a source of power. If the sound generator is placed properly there will be no telltale evidence of the system as when electrical connection is required. The intruder will be taken unawares if the system is actuated; and the lack of understanding of the extent of the signalling is intended to scare him to seek escape.

DESCRIPTION OF THE PREFERRED EMBODIMENT

Figure 1:
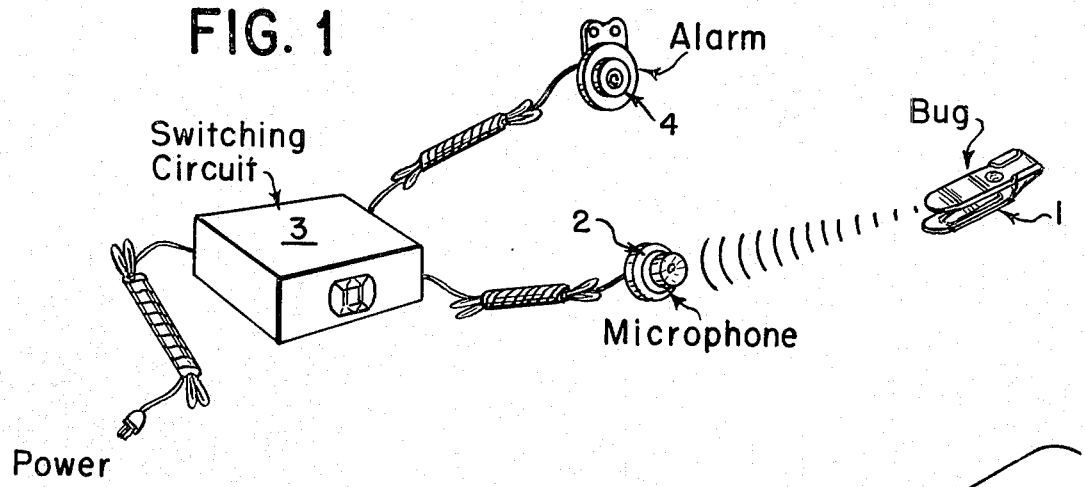
FIG. 1 is a view showing the general operative orientation of the parts of the alarm system of the present invention.

As shown in FIG. 1, the system generally includes a sound generating device 1 (hereinafter referred to as a "bug") capable of producing a distinctive clicking, snapping or similarly generated sound at a repeatable predetermined frequency; a microphone 2 which is sound responsive and capable, upon occurrence of the generated sound, of generating an output; a sound activated switch 3 (hereinafter referred to as a "switching circuit") responsive to the output of the microphone in response to the sound of predetermined frequency; and an alarm 4 which is actuated by the switching circuit. The alarm may be audible and/or visual; and, further, the switching circuit may include the capability of energizing other separate electronic devices such as a light, a recorder or camera.

The primary actuating device of the alarm system of the present invention is the bug 1. Generally, it is adapted to be placed at the various locations where a change in condition is to be monitored; and actuation of the bug is designed to initiate operative of the remotely disposed but hidden alarm section of the system.

Figure 2:
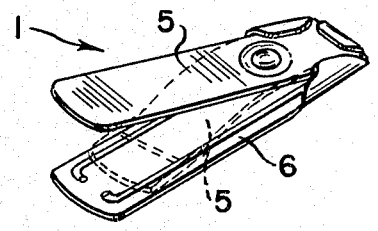
FIG. 2 is a perspective view of a sound generator for use in the system.

In construction, the bug 1 is formed by a dimpled metal strip or blade 5 which is fixed at one end to a base 6. Normally, the blade will extend at an angle from the base as shown in solid lines in FIG. 2 and is armed by movement of the free end into contact with the base as shown by the dotted lines in FIG. 2. Movement of the blade is accompanies by a generated snapping sound both as it moves toward the base and away from the base.

Figure 4:
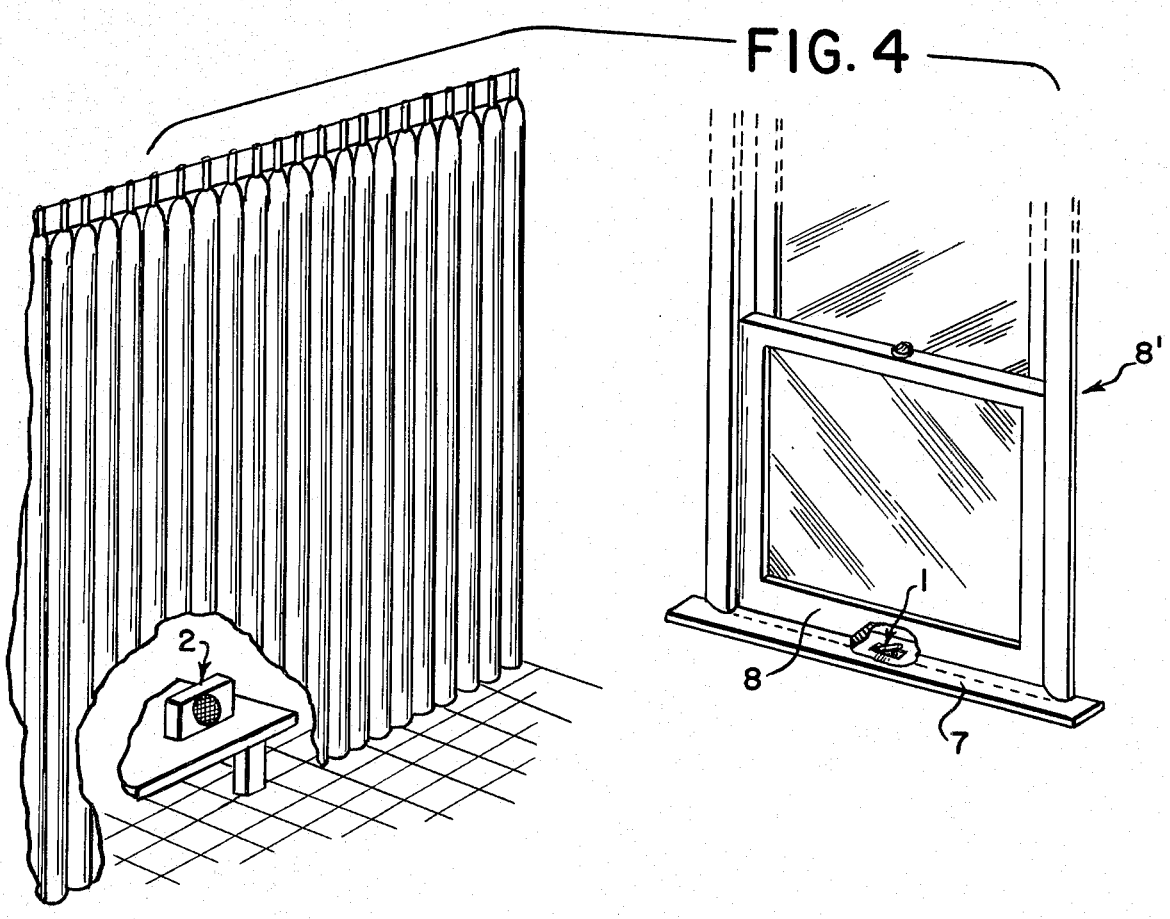
FIG. 4 is a view partially illustrating one application of the system of the present invention.

To protect against unauthorized entry through a window, as shown in FIG. 4 for example, the bug 1 may be disposed adjacent the windowsill 7 in the region below the sash member 8 of the lower half of a conventional double-hung window 8'. A bug, likewise, may be disposed above the sash (not shown) of the upper half of the double-hung window. Preferably, a bug will be utilized with each window half capable of being opened; and if necessary, one or the other of the particular sash or window frame components may be recessed so that the bug may be received therein to permit substantially full closure of the window. In this manner, it will be possible to obviate any suggestive appearance of the presence of a bug.

In the environment of FIG. 4, the restraint on the blade is provided by the sash of the respective window halves. By properly determining the depth of the recess, the bug 1 may be restrained in the armed condition until either the lower half of the window shall have been raised or the upper half shall have been lowered during entry. At such time, the blade 5 which is thereby freed, will snap away from the base, simultaneously generating a snapping sound of predetermined frequency and thereby initiating operation of the alarm section of the system.

In addition to use in a window, the bug 1 may be disposed between a door and the frame or threshold of the door to signal a forced entry to the premises or movement within the premises from room to room. The bug, also, may be employed in the protection of articles of value, such as silver storage chests or portable television or stereo sets, among others. Further, the bug may be utilized in the protection of the contents of a chest of drawers. In these applications and in a host of others which are within the scope of the present invention, movement of one member away from another member removes the restraining force from the blade 5 of bug 1 with the result that the blade rapidly snaps from the armed position and generates the predetermined frequency sound.

Figure 3:
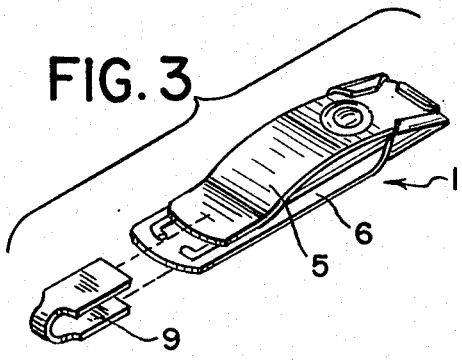
FIG. 3 is a view similar to FIG. 2 of modified embodiment of the sound generator.

Besides its use in detecting unauthorized entry into premises or removal of objects therefrom, the alarm system of the present invention has utility as a fire detection device. FIG. 3 is illustrative of the construction of a bug usable in the system application by which a fire or a condition of extreme heat is signalled. In this application, the bug is provided with a fusible metal clip 9 for holding the blade in armed condition. The clip is formed of a material which displays characteristics of rigidity to maintain the bug 1 armed yet is readily fusible at a desired predetermined temperature, such as 140° F. Accordingly, if this temperature is reached, the clip will melt and permit the blade to snap away from the base. By placing the bug 1 in position well above the floor, either the hot air or flames produced by a fire will be rapidly sensed by the bug.

Figure 5:
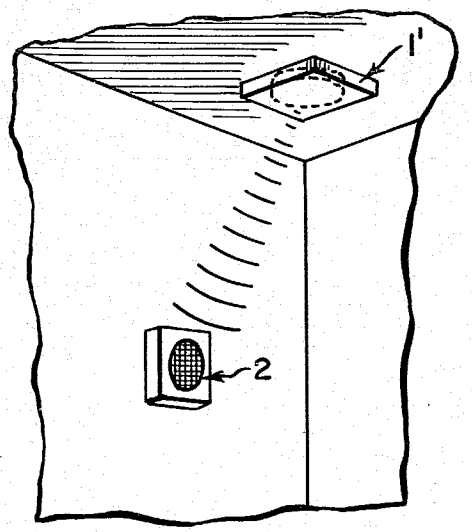
FIG. 5 is a view similar to FIG. 4 illustrating a further application of the present invention.

In a modified construction for detecting extreme heat or fire, a bug 1′ (FIG. 5) in the form of a conventional bimetallic fuse element is mounted at an elevated position such as on or adjacent a ceiling within a room where surveillance is desired. The microphone 2 is disposed within a receiving distance of the bug 1′ to respond to the generated sound when the bimetallic element snaps from one position to another upon sensing the condition, that is a rise in temperature to the response temperature of the fuse element.

In each of the systems applications described above, the snap of the blade 5 generates a sound of short but intense duration. The microphone 2 which picks up this sound to produce a signal for actuating the switching circuit 3 is placed at a remote position but so located to be able to respond to the generated sound and thereby provide an output to the switching circuit 3.

Figure 6:
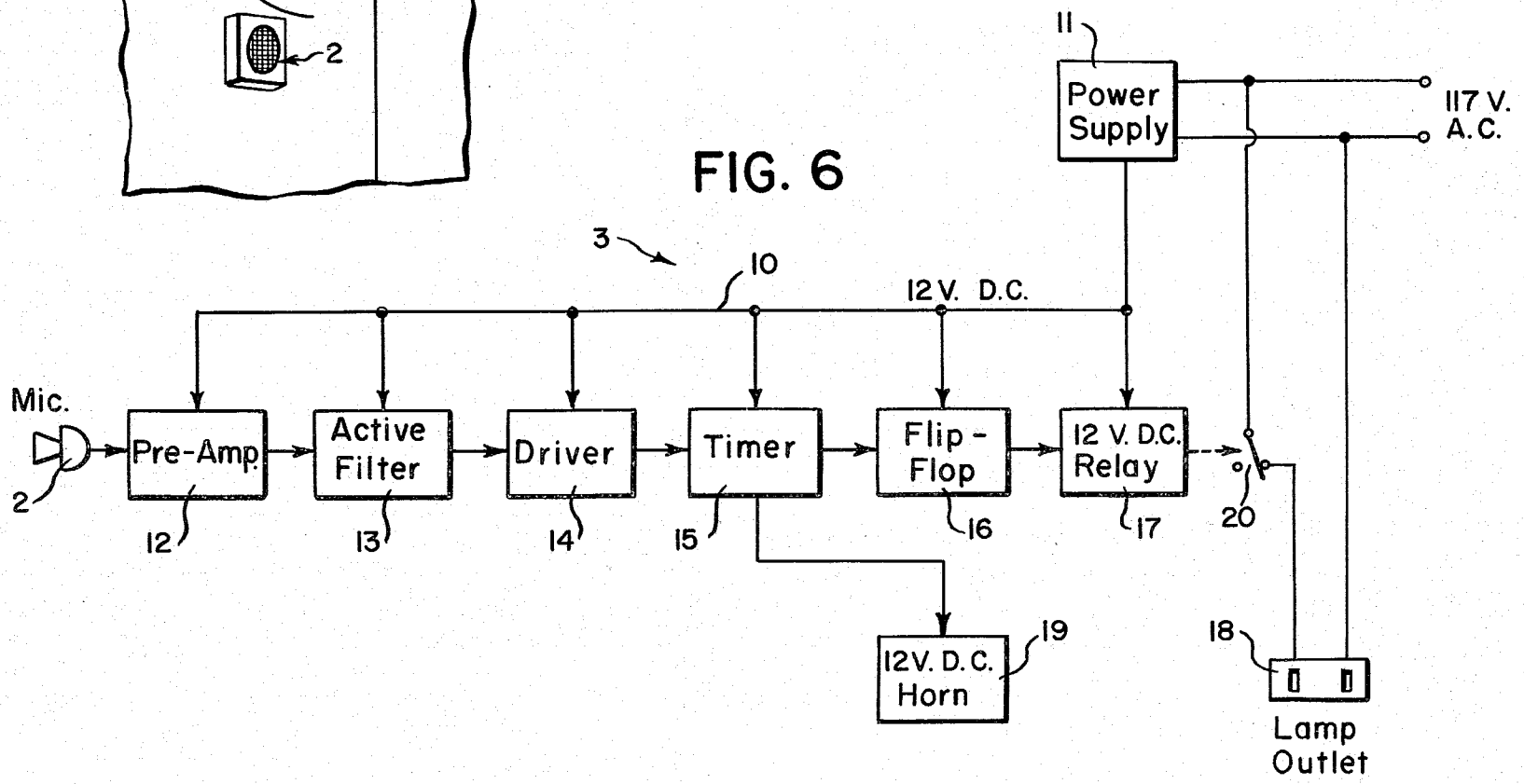
FIG. 6 is a block diagram of the electrical stages of the system.
Figure 7:
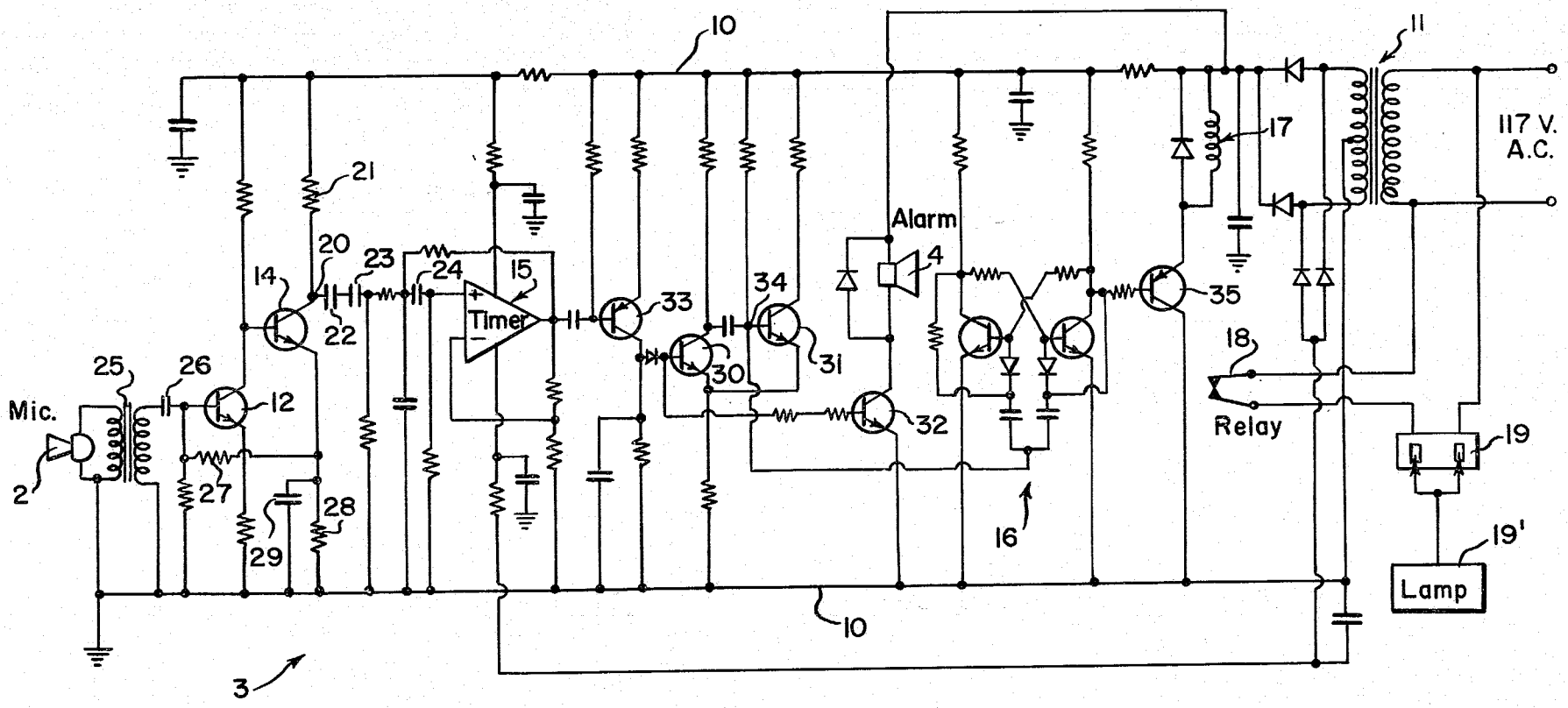
FIG. 7 is a schematic representation of a preferred form of electrical circuit.

The preferred electrical circuit of the alarm system is seen in block diagram form in FIG. 6 and in schematic form in FIG. 7. The circuit may include either a D.C. or a rectified A.C. power supply as illustrated in the figures, to provide a potential of about 12 volts D.C. across the terminals 10 connecting with the secondary of a step-down transformer and conventional rectifier circuit 11. Each of the several stages of the circuit, including a preamplifier 12, an active filter 13, a driver 14, a timer 15, a flip-flop 16 and a relay 17 are connected to the terminals as illustrated in FIG. 6. The microphone 2 as the input to the circuit, responds to a generated sound to provide an electrical output signal which is sensed by the preamplifier 12. The output is amplified, filtered to remove all unwanted frequencies and further amplified at the driver stage 14 to provide an input to the timer 15. Finally, the timer 15 activates the audible alarm 4.

In addition to the above, the switching circuit triggers the flip-flop 16 to a stable conductive stage thereby energizing and maintaining the relay 17 energized. The relay 17 is provided to control one or more switches 18 whose contacts are normally open. When the relay 17 is energized, the switch contacts close to connect a power outlet 19 across the conventional power mains of power supply. At the outlet 19, additional electronic equipment such as a recorder or other monitoring devices may be connected to further monitor the premises upon actuation of the primary alarm. Also, a visual alarm, such as a light 19′, is connected to the outlet.

After a predetermined time interval, the timer opens the circuit to the audible alarm 4. The discontinuance of the alarm 4 may be required in compliance with noise abatement ordinances and the duration of its sounding may be controlled accordingly by the timer 15. The flip-flop 16, which may be a bistable multivibrator, nevertheless continues operation; and since the outlet 19 is connected to proceed in front of the timer, the electronic equipment as well as any visual alarm is maintained in operation. By maintaining the electronic equipment and the visual alarm operative, the owner, if absent, will be advised upon return to the premises that the system was activated upon occurrence of a change in a monitored condition.

Turning to FIG. 7, the preamplifier and a driver of the switching circuit 3 comprise NPN transistors 12 and 14, respectively, whose collectors are connected to the terminals 10. During normal operation, and before actuation of the bug 1, the switching circuit will be in a steady state condition and some small voltage will be present at terminal 20 due to operation of transistor 14 and the voltage drop across resistor 21. However, at steady state, the output at the collector of transistor 14 is blocked by three coupling capacitors 22, 23 and 24 in series with a voltage divider including a resistance to ground. Therefore, at steady state there is no input to the timer 15.

When a bug 1 is activated in response to a change in condition, the microphone 2 responds to generate an alternating current output across transformer 25. This output is coupled by capacitor 26 to the base of transistor 12. A differentiating network, including series resistors 27, 28 and a parallel capacitor 29, functions to by-pass all unwanted frequency signals such as those generated by a ringing telephone, a doorbell, chimes of a clock, among others. The generated sound frequency of the bug applied to the base of transistor 12 causes the transistor to conduct. The result is that transistor 14 ceases to conduct and the voltage at terminal 20 rises immediately to the voltage across terminals 10, that is, to approximately 12V. D.C. The rapid shift in voltage at terminal 20 is coupled to the timer 15 through the network heretofore mentioned to pulse the timer 15 into operation. The timer thus energizes the alarm 4. This is done through various stages of amplification provided by NPN transistors 30, 31 and 32 and PNP transistor 33. The output of the timer at terminal 34 is coupled to the input of the multivibrator flip-flop 16 to trigger it to a stable state of conduction for energization of relay 17 through operation of a transistor 35.

The timer continues to provide an output for a period determined by the make-up and operation of the circuit. During this period, which may be as long as desired or permissible, the alarm 4 will continue to sound. However, at the end of the period, alarm operation is discontinued; but the multivibrator 16 remains in a stable conductive state until the positive potential at terminal 10 is removed. Accordingly, until such time, the relay 17 remains energized and the switch 18 remains closed. Thus, the electronic equipment and lights connected at outlet 19 remain on.

The function of the circuit components of FIG. 7 not specifically mentioned perform conventional circuit operation such as filtering, providing load resistance, the attainment of biasing potentials, as well understood by those skilled in the art. Likewise, the value of the individual components will be in conformity with desired circuit operation.

As will be apparent, the microphone, the switching circuit, and the alarm as well as all connections of the system as installed, may be hidden from view. The alarm 4 may also be disposed outside of the premises such as in a tree or under the eaves of the premises. In this manner, the noise will scare the intruder as well as signal the neighborhood of the intrusion.

One or more bugs 1 may be employed in proximity to the microphone 2 so that the microphone will respond to the generated sound. Preferably, each of the several bugs will be within about 25 feet of the microphone. Care should be taken such that objects interposed generally between the microphone and the bugs do not attenuate the sound waves so that the microphone fails to respond. To this end, it is important to position each bug relative to the microphone such that the microphone will respond to the generated sound from any bug. Positioning of each bug may be checked by plugging in a lamp, for example, at the outlet 19 and thereafter snapping or disturbing each bug, the alarm indication being the illumination of the lamp through closing of a switch 18 contained in the switching circuit. If the lamp does not go on with any actuation of any particular bug, the microphone should be relocated to some position at which it will respond to the bug. At the conclusion of the test the microphone should respond to each bug. During this testing the actuation of the audible alarm may be suppressed by a suitable on-off control on the alarm.

I claim:

1. An alarm system for monitoring and responding to removal of an object from its proper place comprising:

a. a portable generator means for positioning between said object and an associated fixed support for the object, said generator means including:

1. a base,
2. a blade fixed at one end to the base with its other end free and normally disposed in a first position extending at an acute angle away from the base and movable to a second position engaging said base, said blade being armed upon restraining said free end in said second position by positioning between said object and support, said blade further being mechanically formed for generating an audible sound having a predetermined frequency upon movement of its free end from said second position to said first position upon removal of said object from said support;

b. circuit means including a source of electrical power;

c. signal means connected into said circuit means and responsive to said audible sound for providing an electrical output, said signal means being disposed remotely of said generator means; and d. alarm means for signalling the removal of said object from said support, said alarm means included within said circuit means for actuation from a first state to an alarm state under control of said signal means.

2. The alarm system of claim 1 wherein:

a. said blade is of metal construction and dimpled intermediate its ends for generating said sound.

3. The alarm system of claim 2 wherein said alarm means includes:

a. an audible alarm horn.

4. The alarm system of claim 3 wherein said alarm means further includes:

a. a visual alarm light.

5. The alarm system of claim 4 wherein said circuit means includes:

a. a normally open switch connecting said light to said source of power; and b. relay means operable to close said switch, said relay means being under control of said signal means.

6. The alarm system of claim 5 including:

a. a timer connected in said circuit means and operable after a predetermined period of time to deactivate said audible alarm to said first state.

7. The alarm system of claim 6 wherein:

a. the normally open switch is disposed within said circuit means between the timer and the source of power to supply power to said light independently of subsequent operation of said time.

* * * * *